US009174484B2

(12) United States Patent
Enguita

(10) Patent No.: US 9,174,484 B2
(45) Date of Patent: Nov. 3, 2015

(54) ROLLABLE PAINT TRAY

(71) Applicant: Steven Edward Enguita, Fort Myers, FL (US)

(72) Inventor: Steven Edward Enguita, Fort Myers, FL (US)

( * ) Notice: Subject to any disclaimer, the term of this patent is extended or adjusted under 35 U.S.C. 154(b) by 125 days.

(21) Appl. No.: 13/747,109

(22) Filed: Jan. 22, 2013

(65) Prior Publication Data

US 2014/0096338 A1 Apr. 10, 2014

Related U.S. Application Data

(63) Continuation-in-part of application No. 13/647,446, filed on Oct. 9, 2012.

(51) Int. Cl.
*B44D 3/12* (2006.01)

(52) U.S. Cl.
CPC ..... *B44D 3/126* (2013.01)

(58) Field of Classification Search
CPC ..... B44D 3/126; B44D 3/14; B44D 3/121; B44D 3/127; B44D 3/128
USPC ..... 15/257.06; 220/570
See application file for complete search history.

(56) References Cited

U.S. PATENT DOCUMENTS

| | | | | |
|---|---|---|---|---|
| 6,493,901 | B1 * | 12/2002 | Jones | 15/257.06 |
| 7,194,786 | B2 * | 3/2007 | Gagne | 16/406 |
| 7,424,959 | B1 * | 9/2008 | Biebel | 220/23.87 |
| 2004/0238399 | A1 * | 12/2004 | Billado, Jr. | 206/564 |
| 2006/0260086 | A1 * | 11/2006 | Boehm | 15/257.06 |

* cited by examiner

*Primary Examiner* — Shay Karls
(74) *Attorney, Agent, or Firm* — William E. Noonan

(57) ABSTRACT

A rollable paint tray which will be maneuvered on a floor by the painter manipulating an extended handle of a paint roller assembly is disclosed. The tray will have a body, a plurality of rolling members and a structural configuration which permits placement of the paint roller on the tray where it will remain in contact during maneuvering of the tray by the painter. The body has a paint containment area, a paint roller containment area and a rolling surface area. The painter may easily replenish fresh paint on the paint roller and roll the paint roller to obtain a desired quantity and uniformity of coverage on the paint roller. The tray permits the painter to paint a large area, along a great distance, while remaining standing straight. This eliminates the conventional need for the painter to manually move their supply of fresh paint which often involves bending or squatting.

19 Claims, 6 Drawing Sheets

'PRIOR ART'

ROLLABLE PAINT TRAY

CROSS-REFERENCE

This application is a continuation-in-part of Ser. No. 13/647,446 filed Oct. 9, 2012, entitled "Rollable paint bucket", currently pending. The original application is incorporated herein by this reference.

BACKGROUND

1. Field of the Invention

Generally, the invention relates to containers to contain paint during a painting procedure. More specifically, the invention relates to such containers having a paint rolling surface slightly offset from horizontal and capable of being easily moved about the floor by the painter during the painting procedure.

2. Description of the Prior Art

Various methods are known to apply paint to a wall surface. It may be mechanically sprayed on the wall surface without any paint retaining structure actually touching the wall surface. This method is not directly applicable to the present invention and will not be discussed further. Typically a paint retaining structural element will have paint placed on the paint retaining structural element with transfer of such paint occurring by wiping or rolling the paint retaining structural element on the wall surface. The two most common painting tools having applicable paint retaining structural elements are the paint brush and the paint roller. The present invention may be utilized with paint brushes to significantly enhance the painting experience during use of the paint brush. The present invention is generally related to use of the paint roller, and more particularly, to use with the paint roller deployed with a long handle. Paint rollers have a cylindrical portion with a paint retaining surface, such as a mat material, rotationally mounted to a manipulation part, typically in the form of a handle. Most modern paint roller handles have means to attach a long extension handle thereto, such as a female threaded cavity in the end of the handle to receive threads on a male end of the long extension handle. During use paint is gathered on the paint retaining surface of the cylindrical portion to a desired uniformity and density and then the paint retaining surface is rolled along the wall surface to transfer the paint to the wall surface.

Painters of wall surfaces have personal preferences for painting equipment utilized and the orientation of, and interaction with, that painting equipment during their respective painting. The following description depicts a typical conventional painting procedure performed on a large interior or exterior wall surface of a structure. The three most common methods of containment of the paint utilized for such a project are used during this description.

The first method is use of a bulk paint container, such as a round five gallon bulk paint bucket, and working directly from the round bulk paint container. Such use of round bulk paint buckets typically require use of an insert having a planar rolling surface positioned thereon with the insert placed partially into the round bulk bucket. In order to utilize the planar rolling surface for the intended use the bulk bucket will contain well less than the containment capacity of paint where a large portion of the insert is above the level of the paint. In use the paint roller will be placed in contact with the paint and then rolled along the planar surface of the insert to uniformly distribute the paint on the roller.

The second method is use of a large dedicated paint bucket designed to hold a relatively large quantity of paint, such as several gallons, while allowing use of a conventional paint roller. Such bulk paint buckets will typically either have a flat surface on them to roll the paint roller on above the paint contained in the bucket or will accept an insert having a planar rolling surface positioned thereon with the dedicated paint bucket.

The third method is use of a paint roller pan with an upward sloped rolling surface extending from a deeper paint containment end. Typically these paint roller pans contain no more than a gallon of paint at a time and are rectangular in shape, with slightly rounded corners, when viewed from above. Such paint roller pans will often have structures thereon to position the pan in a stable and secure manner on a ladder at an elevated position above the floor. This ladder placement method permits the painter to stand on the ladder during painting. This orientation is more often used with a handheld paint brush than with a paint roller. When a paint roller pan is used with a paint roller with long handle assembly, the paint roller pan will often rest on the floor adjacent the wall surface being painted. It is known in the art to provide wheels on conventional paint roller pans where they may be moved about by the painter during the painting procedure. Such conventionally known wheeled paint roller pans typically do not have a dedicated area for placement of the paint roller of a paint roller assembly fitted with an elongated handle for easy manipulation of the painter.

Each of these three methods of paint containment, bulk paint container, large dedicated paint bucket and paint roller pan, suffer from various deficiencies. When used with a paint roller having an extension handle they are all most often used while the respective paint container is resting on the floor. This floor positioning allows the painter to easily use the long extension handle to manipulate the paint roller portion to deposit a desired amount of paint, and to a uniform manner, on the paint roller while the painter remains standing straight without bending over or stooping. The painter will then manipulate the extension handle to transfer the paint from the paint roller to the wall surface. With the extension handle this may be done from near floor level to near ceiling level while the painter remains standing straight without bending over or stooping. The main problem occurs when the painter has painted an area of the wall surface and moves to start painting the next adjacent portion of the wall surface. It then becomes necessary to physically move the paint container a similar distance or for the painter to move over to the paint container each time replenishment of a fresh supply of paint on the paint roller is required. Each of these options is time consuming. Eventually the paint container will be moved to a new location during a painting procedure. It being understood that bending, stooping or squatting to physically engage a paint container has been known to cause injury to painters. Additionally, such activities, even in the absence of injury, tend to tire and fatigue the painter. It is also understood that such displacement of paint containers occasionally result in the spillage of paint onto the floor, or onto any protective covering placed on the floor during the painting procedure. Such spillage is expensive as it always wastes some paint and occasionally causes damages to objects not intended to have paint applied to. When the conventionally known paint trays having wheels are utilized the painter does not have a safe position to place the paint roller in where inadvertent spillage of paint is eliminated.

As can be seen there remains a need for a paint tray which will retain paint, allow easy and uniform placement of the paint on a paint roller having an extension handle and which can be easily moved about during the painting procedure as desired by the painter, all while the painter remains standing straight without bending or stooping. The present invention substantially fulfills these needs.

SUMMARY

In view of the foregoing disadvantages inherent in the known methods of containing paint during painting procedures, your applicant has devised a rollable paint tray to retain paint during a painting procedure. The painting procedure is performed with a paint roller assembly having a paint roller, a paint roller retention assembly and an elongated handle. The paint roller retention assembly provides for axial rotation of the paint roller while the elongated handle provides for a significant spacing of a painter from the paint roller during the painting procedure. The rollable paint tray has a body having a usage orientation during the painting procedure which is relative to a generally flat support surface. The body has a workpiece paint containment area, a rolling surface area and a paint roller containment area. The workpiece paint containment area provides for containment of a quantity of the workpiece paint and ready access for transfer of a portion of the workpiece paint contained in the workpiece paint containment area to the workpiece paint roller assembly during the painting procedure. The rolling surface area provides for distribution of workpiece paint onto the workpiece paint roller assembly during the painting procedure. The rolling surface area has an angular offset from horizontal when the rollable paint tray is positioned in the usage orientation and an angular offset from vertical when the rollable paint tray is positioned in the usage orientation. The angular offset of the rolling surface area from horizontal is significantly less than the angular offset of the rolling surface area from vertical. The paint roller containment area provides for the workpiece paint roller of the workpiece paint roller assembly to be placed relative to the rollable paint tray where the user may manipulate the elongated workpiece handle of the workpiece paint roller assembly to easily move the rollable paint tray about on the generally flat support surface during the painting procedure. The rollable paint tray also has a plurality of rolling members attached relative to the body of the rollable paint tray. The rolling members provide for ready movement of the rollable paint tray over the generally flat support surface during the painting procedure.

My invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore a primary object of the present invention to provide for a rollable paint tray which will be easily moved about the floor while the painter remains standing upright while painting with a paint roller with an extension handle.

Other objects include;

a) to provide for the rollable paint tray to have a paint containment area and rolling surface area positioned adjacent the paint containment area.

b) to provide for the rollable paint tray to have a paint roller containment area, which is generally behind rolling surface area, for placement of the paint roller during manipulated movement of the rollable paint tray where the painter will be able to easily manipulate movement of the rollable paint tray about the floor.

c) to provide for the rolling surface area for rolling of the paint roller to be angularly offset between horizontal and vertical while being significantly nearer to horizontal than to vertical.

d) to provide for the rollable paint tray to have attachable/detachable rolling members where the remainder of the rollable paint tray is stackable for storage and transport when the rolling members are removed.

e) to provide for drainage of paint from the paint roller containment area to the workpiece paint containment area across the rolling surface area.

f) to provide for angularly offset channels to cross the rolling surface area to provide for the drainage of paint from the paint roller containment area to the paint containment area.

g) to provide for the paint roller containment area to have a curved base complementary to a shape of the paint roller.

h) to provide for the paint containment area to be relatively deep and relatively short in width where an adequate supply of paint may be stored.

i) to provide for a plurality of elevated strips to be positioned on the rolling surface area which are linear and angularly offset relative to the rolling orientation of the workpiece paint roller.

j) to provide for opposing drainage channels across the rolling surface area which start at opposing ends of the paint roller containment area and converge to a common drainage point in the center of the edge of the paint containment area.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION

Figure 1:
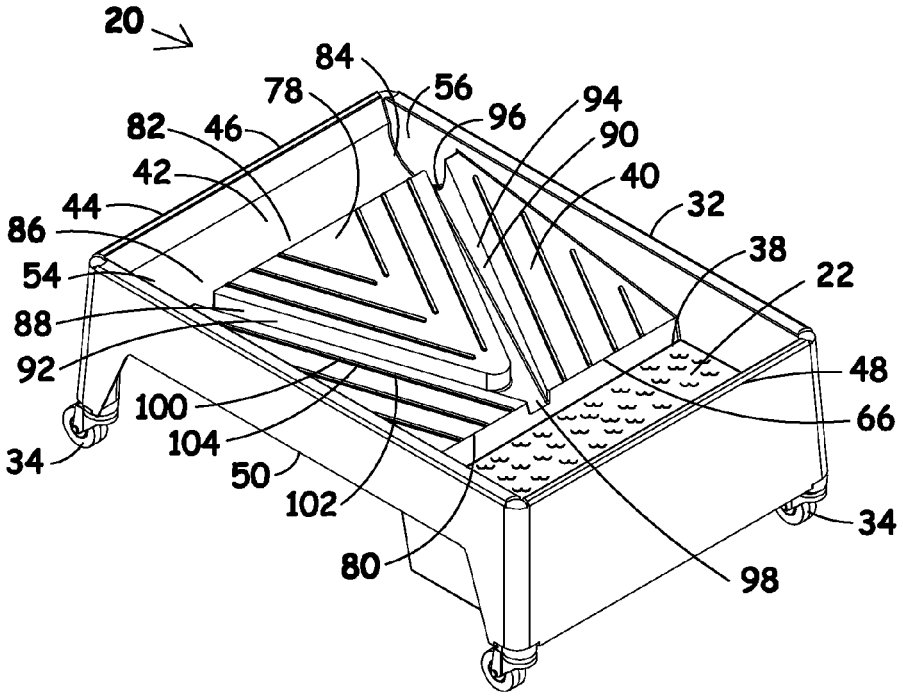
FIG. 1 is a perspective view of a rollable paint tray, with workpiece paint therein.
Figure 2:
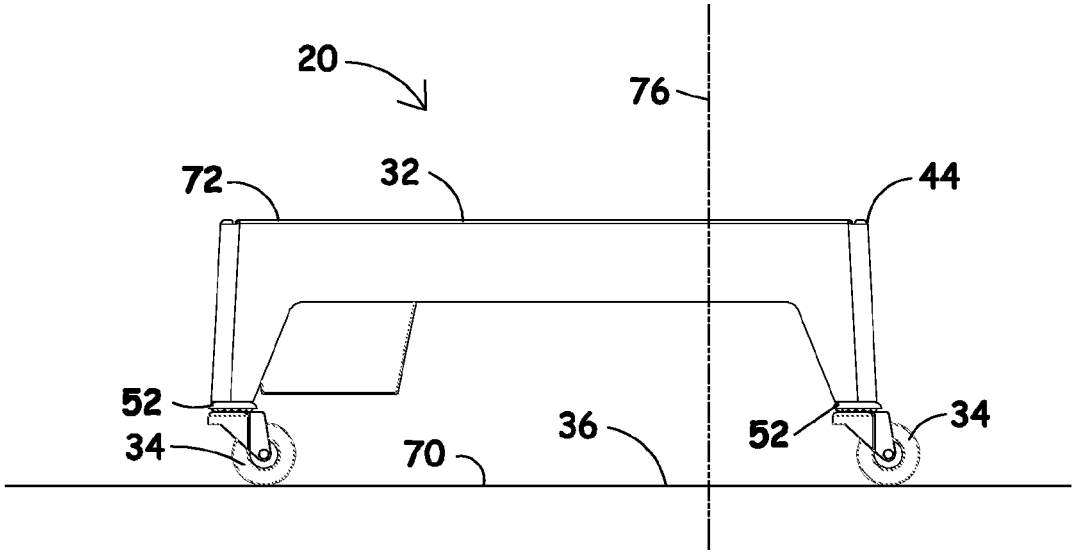
FIG. 2 is a side elevational view of the rollable paint tray depicted in FIG. 1.
Figure 3:
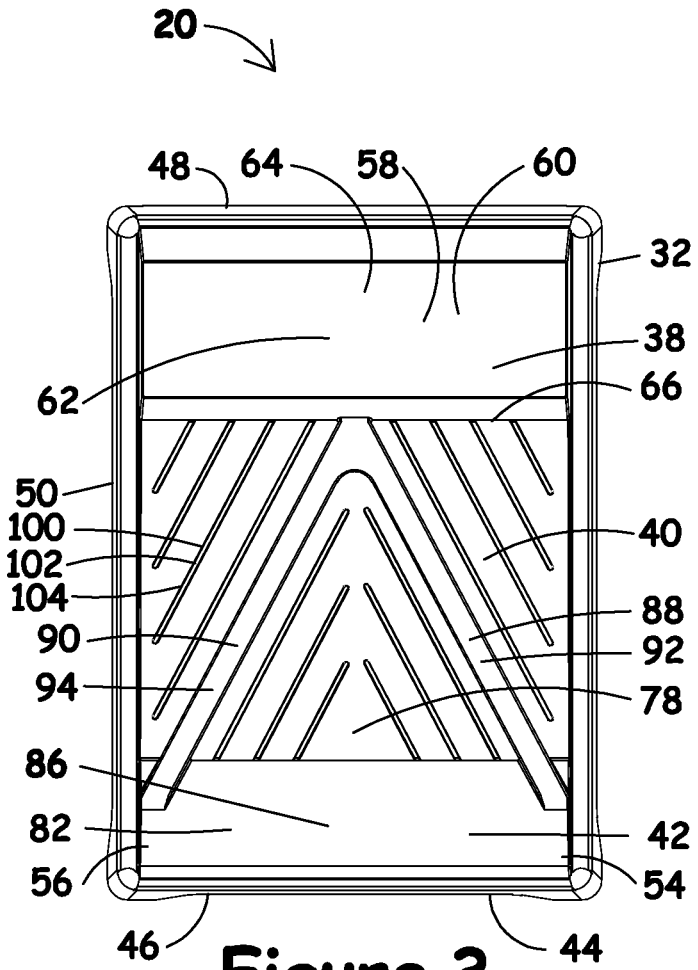
FIG. 3 is a top plan view of the rollable paint tray depicted in FIG. 1.
Figure 4:
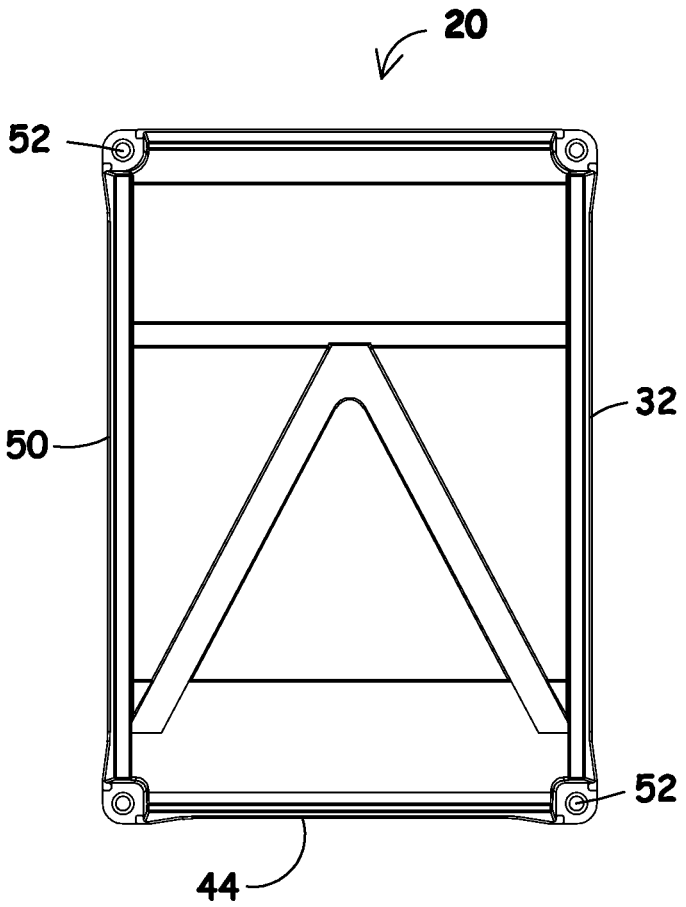
FIG. 4 is a bottom plan view rollable paint tray depicted in FIG. 1.

Many different devices having features of the present invention are possible. The following description describes the preferred embodiment of select features of those devices and various combinations thereof. These features may be deployed in various combinations to arrive at various desired working configurations of devices.

Reference is hereafter made to the drawings where like reference numerals refer to like parts throughout the various views.

The invention is a rollable paint tray capable of retaining paint and being easily moved about as desired by the painter during a painting procedure. Such movement will typically be on the floor of the area being painted. As is conventionally known for painting, the floor area will typically be covered with some temporary covering, such as plastic sheet material or a canvas tarp. It being understood that applicable rollable paint trays will be on top of such coverings and will roll about on those coverings.

In order to avoid repetitive bending over and standing up, applicable rollable paint trays will provide for the painter to utilize a conventional paint roller, with a conventional elongated handle extending therefrom, during the painting procedure. This combination of the rollable paint tray with the paint roller on a long handle permits the painter to stand upright during painting of a relatively large area. The painter will gather paint on the paint roller, apply that paint to a surface being painted in a repetitive manner and move the rollable paint tray to a new position all without moving significantly from the standing posture. When the painter moves slightly to position at a new unpainted area of the surface being painted, the painter will move the rollable paint tray a generally equal distance as their move utilizing manipulation of the handle of the paint roller. This eliminates stooping to move the paint tray and eliminate having to lift the paint tray off of the floor. It being understood that such lifting of conventional paint trays occasionally results in a spilling of paint from the paint tray. This also provides for the painter retain the paint roller assembly during an entire painting session from the time of placement of paint in the rollable paint tray until either the paint supply is depleted or until the area to be painted with the paint rolling is painted. In this manner a large surface area may be painted without requiring the painter to bend over even once or having to pick up the paint tray even once or to set down, or otherwise release, the paint roller assembly.

The term painting procedure as used herein refers generally to the gathering of workpiece paint from a rollable paint tray having features of the present invention onto a workpiece paint roller assembly for some useful purpose. It is only necessary that the comparative rollable paint tray being considered have the ability to perform those functions. It is envisioned that painters will utilize a rollable paint tray having features of the present invention with a workpiece paint brush without utilizing the workpiece paint roller assembly. Such possible exclusion of utilization of the workpiece paint roller assembly with an applicable rollable paint tray should not be viewed as limiting the scope of the present invention.

Overview

Figure 5:
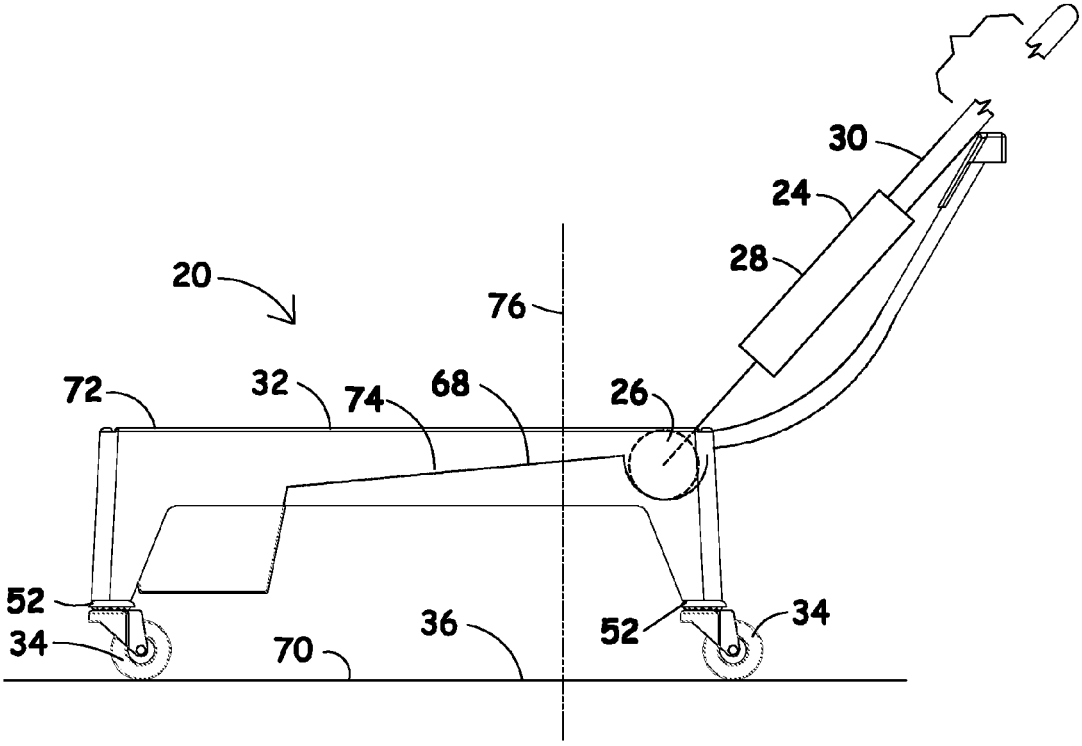
FIG. 5 is a side elevational view of the rollable paint tray depicted in FIG. 1 with portions of a workpiece paint roller assembly and select portions of the rollable paint tray depicted with dashed 'hidden lines' to depict placement and orientation of various components.
Figure 6:
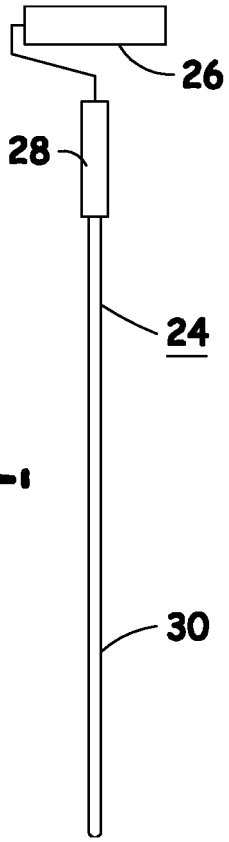
FIG. 6 is a side elevational view of a workpiece paint roller assembly and labeled as 'Prior Art'.

A rollable paint tray 20 retains workpiece paint 22, shown in FIG. 1, during a painting procedure performed with a workpiece paint roller assembly 24, shown in FIG. 5 and FIG. 6. It being understood that the various workpieces, and their respective parts, are not part of the present invention.

Certain workpieces will be utilized with the present invention and are recited within the claims as workpieces. Such workpieces are recited in the claims and in this specification to give meaning to the various claimed features of the present invention. Again, it is noted that the workpieces form no part of the present invention.

Workpiece Paint Roller Assembly

The present invention utilizes a workpiece paint roller assembly having an elongated handle. While various styles are commercially available, and even more in the prior art, generally all such known paint roller assemblies are applicable for use with the present invention.

FIG. 6 depicts workpiece paint roller assembly 24 having various components, all conventionally known in the art, and labeled as 'Prior Art'. A workpiece paint roller 26, a workpiece paint roller retention assembly 28 and an elongated workpiece handle 30 form workpiece paint roller assembly 24. Workpiece paint roller retention assembly 28 provides for axial rotation of workpiece paint roller 26 on workpiece paint roller assembly 24. Elongated workpiece handle 30 is attached to workpiece paint roller retention assembly 28 and provides for significant spacing of the user, no shown in any of the views, from workpiece paint roller 26 during the painting procedure.

Rollable Paint Tray

Rollable paint tray 20 has a body 32 and a plurality of rolling members 34 attached relative to body 32. Body 32 has a usage orientation during the painting procedure relative to a generally flat support surface 36. As further described below body 32 has a paint containment area 38, a rolling surface area 40 and a paint roller containment area 42. Rollable paint tray 20 has a user accessible end 44 where the user would routinely stand during use of rollable paint tray 20 during the painting procedure.

Body 32 has a first end 46 and a second end 48. Workpiece paint containment area 38 is positioned at first end 46 of body 32. Paint roller containment area 42 is positioned at second end 48 of body 32. Body 32 preferably is a one piece molded member 50. Body 32 has a plurality of rolling member attachment positions 52. Each rolling members 34 is detachably attachable to a respective rolling member attachment position 52.

Paint containment area 38 provides for containing a quantity of workpiece paint 22. Paint containment area 38 is readily accessible for transfer of a portion of workpiece paint 22 contained in paint containment area 38 to workpiece paint roller assembly 24 during the painting procedure. Paint roller containment area 42 has opposing ends 54 and 56. Preferably paint roller containment area 42 is positioned on body 32 at user accessible end 44 of rollable paint tray 20. Paint containment area 38 has a base 58 having an elevational height 60. Paint containment area 38 has a width 62 and a depth 64. Width 62 extends forward from a terminal edge 66 of rolling surface area 40. Depth 64 extends downward from terminal edge 66 of rolling surface area 40. Width 62 and depth 64 of workpiece paint containment area 38 are generally equal.

Rolling surface area 40 provides for distribution of workpiece paint 22 onto workpiece paint roller assembly 24 during the painting procedure. Rolling surface area 40 has an angular offset 68 from horizontal 70 when rollable paint tray 20 is positioned in a usage orientation 72 and angular offset 74 from vertical 76 when rollable paint tray 20 is positioned in usage orientation 72. Angular offset 68 from horizontal 70 is significantly less than angular offset 74 from vertical 76. Rolling surface area 40 further comprises a rolling orientation 78 where workpiece paint roller 26 is routinely moved during the painting procedure. Rolling surface area 40 has a lowest elevational extent 80.

Paint roller containment area 42 provides for workpiece paint roller 26 of workpiece paint roller assembly 24 to be placed relative to rollable paint tray 20 where the user, not shown in any of the views, may manipulate elongated workpiece handle 30 of workpiece paint roller assembly 24 to easily move rollable paint tray 20 about on generally flat support surface 36 during the painting procedure. Paint roller containment area 42 has a base 82 having a curved contour 84. Curved contour 84 is generally complementary to the shape of workpiece paint roller 26. Base 83 of paint roller containment area 42 has an elevational height 86.

Elevational height 86 of base 82 of paint roller containment area 42 is significantly elevated above elevational height 60 of base 58 of workpiece paint containment area 38.

Base 82 of paint roller containment area 42 is higher that lowest elevational extent 80 of rolling surface area 40.

Rolling members 34 are attached relative to body 32 of rollable paint tray 20. Rolling members 34 provide for ready movement of rollable paint tray 20 over generally flat support surface 36 during the painting procedure.

Drainage Means

Some structural configuration will be provided where at least a portion of workpiece paint deposited in the paint roller containment area will be transferred to the workpiece paint containment area. It being understood that the structural members providing for the drainage means could take many configurations and orientations. Such structures preferably will be exposed but they may be actual closed ducts which are not visible. Preferably they will extend across the rolling surface area but that is dependant on placement of the various elements and, even when the workpiece paint containment area and the paint roller containment area are positioned at opposing ends of the body with the rolling surface area therebetween, the drainage structures can be positioned beyond the usable surface of the rolling surface area.

Paint roller containment area 42 has drainage means, depicted in the preferred embodiment as drainage channels 88 and 90, to provide for at least a portion of workpiece paint 22 deposited in paint roller containment area 42 to drain into workpiece paint containment area 38 of body 32 of rollable paint tray 20. Drainage channels 88 and 90 have a directional orientation 92 and 94 respectively. Directional orientation 92 and 94 of drainage channels 88 and 90 are each offset relative to rolling orientation 78 of rolling surface area 40. Drainage channels 88 and 90 each extend across rolling surface area 40 from paint roller containment area 42 to workpiece paint containment area 38. Drainage channels 88 and 90 converge toward paint containment area 38. Drainage channels 88 and 90 are positioned respectively at opposing ends 54 and 56 of paint roller containment area 42. Drainage channels 88 and 90 each have a first depth 96 relative to rolling surface area 40 and a second depth 98 relative to rolling surface area 40. First depth 96 is positioned adjacent paint roller containment area 42 while second depth 98 is positioned adjacent workpiece paint containment area 38. First depth 96 is greater than second depth 98.

Elevated Strips

Rolling surface area 40 further has a plurality of elevated strips 100 positioned thereon. Elevated strips 100 act to enhance the distribution of workpiece paint 22 onto workpiece paint roller 26. Each elevated strip 100 has a generally linear orientation 102. It being understood that many variously in configuration are possible, including curved, wavy, zigzag and many others. Each elevated strip 100 has a directional orientation 104 which is offset relative to rolling orientation 78 of rolling surface area 40. Each elevated strip 100 of rolling surface area 40 is preferably aligned with either drainage channel 88 or 90.

Rollable paint trays having features of the present invention may have a fairly wide range of workpiece paint capacities. Preferable rollable paint trays will have a usage limit of one (1) US gallons, or slightly less. This capacity provides for the rollable paint tray to be small enough to be readily handled, stored and transported.

The user will have the ability to place a workpiece paint roller of a workpiece paint roller assembly relative to an applicable rollable paint tray and for the user to manipulate an elongated workpiece handle of the workpiece paint roller assembly to move the rollable paint tray about a surface. Preferably this will take the form of a specific structural configuration on the applicable rollable paint tray where the workpiece paint roller will make contact, such as a paint roller containment area. Ideally, the deployed paint roller containment area will accept placement of the workpiece paint roller during user controlled movement of the rollable paint tray as well as during times that the user merely desires to release the workpiece paint roller assembly in order to rest or to perform some other task where the workpiece paint roller assembly will remain and not fall. This resting may be accomplished by having structures on the body which contact some portion of the workpiece paint roller assembly or, more preferably, will involve some attachable assembly or piece which is the positioned on the body to provide this feature. This attachable nature provides for applicable rollable paint trays to be compact for shipping, transport and storage.

Rollable paint trays having features of the present invention will have some rolling members which will permit movement of the rollable paint tray across a generally flat surface. The art is rich with rolling members, including wheeled embodiments, which may be utilized to provide this required feature. In the most preferred embodiments the rolling members will be attachable relative to the body of such embodiments. Ideally such attachment to the body utilizes an attachment method which permits removal of the rolling members by the user and reattachment of the rolling members by the user. This arrangement is useful during storage or transport, but is also useful during cleaning of the applicable rollable paint tray.

It is preferred that any deployed rolling members be capable of permitting the applicable rollable paint tray to be turned easily and rolled in any desired direction. A class of rolling members conventionally known in the art provides this feature without requiring swiveling of the rolling member, and such rolling members may be utilized. Alternatively, rolling members conventionally known in the art swivel about a vertical axis and it is preferred that such rolling members be utilized for the present invention.

It is rare to have a sloped surface where painting is occurring and where it is desired to place the rollable paint tray. For those occasions it is a desire that applicable rollable paint trays having at least one rolling member with locking means to prevent rotation of the rolling member. This locking of a select wheel will prevent significant movement of the rollable paint tray. Various locking assemblies for applicable rolling members are known in the art and many of these may be utilized with the present invention. When deployed, it is preferred that the user be able to manipulate the locking of the rolling member and the unlocking of the rolling member while standing at the user accessible end of the respective rollable paint tray. Ideally such locking and unlocking will be performed while the user stands upright without requiring the user to bend, stoop or squat. This is easily provided for by having the structural components of the locking mechanism operational using a portion of the foot of the user, not shown in any of the views. Such foot operated locking mechanisms for rolling members are well known in the art and many of these may be utilized with the present invention.

In a less preferred embodiment of rollable paint tray the deployed rolling members may be permanently attached to the rollable paint tray. Similarly in a less preferred embodiment to that depicted in the drawings, the deployed rolling member may be attached, removably or permanently, to a separate structural component from the body of the rollable paint tray. This separate structural component would then be attached to, or positioned relative to, the body of an applicable rollable paint tray.

Rollable paint trays having features of the present invention can be fitted with a workpiece liner to contact the workpiece paint. Workpiece liners can protect many of the surfaces of the rollable paint tray to which is fitted from contact with, and accumulation thereon of, workpiece paint. A workpiece liner also will make cleanup of the rollable paint tray fitted with a workpiece liner much easier and far less time consuming. If desired the workpiece liner can be left on the rollable paint tray for extended periods of time spanning multiple painting sessions, including allowing remaining workpiece paint to dry. After an unacceptable accumulation of residual paint, or when changing to use another type or color of paint in the rollable paint tray, the used workpiece liner can be removed and a fresh liner installed.

The workpiece liner preferably will be configured to fit any of the various structural configurations of the specific embodiment of the rollable paint tray upon which it will be deployed. Rollable paint trays having features of the present invention will preferably be formed of a plastic within molds using an injection molding process. Due to the limitation that such rollable paint trays will have to be releasable from the mold during the injection molding process, workpiece liners can be formed which will slip into, and snugly fit, a respective embodiment of rollable paint tray.

Preferably the workpiece liner will fit within the rollable paint tray covering all surfaces upon which workpiece paint will routinely make contact. This will include the workpiece paint containment area and the paint roller containment area, including the opposing paint drainage channels, and the rolling surface area preferably positioned between these two areas. Preferably, the workpiece liner will overlap any of the radially disposed upper edges of the rollable paint tray.

The workpiece liner will be formed of a suitable paint impermeable material. The workpiece liner can be formed of a plastic sheet material in a vacuum molding process. Alternatively, the workpiece liner can be formed of a plastic using an injection molding process. Other applicable construction methods may be utilized. Both the vacuum molding and the injection molding options are capable of creating a relatively rigid, free standing, workpiece liner which will be easier to install and remove than a flexible workpiece liner. It is possible to form the workpiece liner from a much more pliant material having the desired shape and configuration. This type would have the advantage of being foldable for easy packaging, transport and storage. This type, while more time consuming to install and remove from applicable rollable paint trays than the rigid or semi-rigid type, would be easier to dispose of as it can more readily be gathered from the edges and may be gathered into a smaller area for subsequent disposal.

With either the rigid or semi-rigid workpiece liner or the more pliant foldable workpiece liner various securement methods can be utilized to ensure that the workpiece liner remains in a deployed orientation on the rollable paint tray. Preferably such securement methods utilize the upper radial edge of the workpiece liner, and corresponding contacting portions of the rollable paint tray, to secure the workpiece liner relative to the rollable paint tray. Of course, the simplest securement method involves taping of the workpiece liner to the exterior upper and/or side surfaces of the rollable paint tray. More complicated securing devices, such as pressure bearing clips, positioned on the rollable paint tray may be utilized. Yet another applicable option involves a series of snap type couplings having male and female portions. One set of members would be positioned on the rollable paint tray while corresponding, and opposing, members would be positioned on the workpiece liner. Once the workpiece liner is positioned relative to the rollable paint tray each set of the snap type couplings on the workpiece liner and the rollable paint tray would be fastened to secure the workpiece liner to the rollable paint tray. Other applicable securement methods, conventionally known in the art, can be used.

A lid, either completely removable or hinged, preferably will be provided with rollable paint trays having features of the present invention. This will provide for leaving the rollable paint tray for brief breaks from painting without undue concern that the condition of paint contained within the rollable paint tray will deteriorate.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rollable paint tray to retain workpiece paint during a painting procedure performed with a workpiece paint roller assembly, the workpiece paint roller assembly having a workpiece paint roller, a workpiece paint roller retention assembly and an elongated workpiece handle, the workpiece paint roller retention assembly to provide for axial rotation of the workpiece paint roller, the elongated workpiece handle attached to the workpiece paint roller retention assembly to provide for significant spacing of the user from the workpiece paint roller during the painting procedure, the rollable paint tray comprising:

a) a body having a usage orientation during the painting procedure relative to a generally flat support surface, the body comprising:

i) a workpiece paint containment area to provide for containing a quantity of the workpiece paint, the workpiece paint containment area readily accessible for transfer of a portion of the workpiece paint contained in the workpiece paint containment area to the workpiece paint roller assembly during the painting procedure;

ii) a rolling surface area to provide for distribution of workpiece paint onto the workpiece paint roller assembly during the painting procedure, the rolling surface area having an angular offset from horizontal when the rollable paint tray is positioned in the usage orientation and an angular offset from vertical when the rollable paint tray is positioned in the usage orientation and wherein the angular offset from horizontal is significantly less than the angular offset from vertical;

iii) a paint roller containment area to provide for the workpiece paint roller of the workpiece paint roller assembly to be placed relative to the rollable paint tray wherein the user will manipulate the elongated workpiece handle of the workpiece paint roller assembly to easily move the rollable paint tray about on the generally flat support surface during the painting procedure;

and wherein the paint roller containment area further comprises drainage means to provide for at least a portion of the workpiece paint deposited in the paint roller containment area to drain into the workpiece paint containment area of the body of the rollable paint tray;

b) a plurality of rolling members attached relative to the body of the rollable paint tray, the rolling members to provide for ready movement of the rollable paint tray over the generally flat support surface during the painting procedure.

2. The rollable paint tray defined in claim 1 wherein the body has a first end and a second end and wherein the workpiece paint containment area is positioned at the first end of the body and wherein the paint roller containment area is positioned at the second end of the body.

3. The rollable paint tray defined in claim 1 further comprising a user accessible end where the user would routinely stand during use of the rollable paint tray during the painting procedure, and wherein the paint roller containment area is positioned on the body at the user accessible end of the rollable paint tray.

4. The rollable paint tray defined in claim 1 wherein the rolling surface area further comprises a rolling orientation where the workpiece paint roller is routinely moved during the painting procedure and wherein the drainage means further comprises a drainage channel having a directional orientation and wherein the directional orientation of the drainage channel is offset relative to the rolling orientation of the rolling surface area.

5. The rollable paint tray defined in claim 1 wherein the drainage means further comprises at least two drainage channels extending across the roller surface from the paint roller containment area to the workpiece paint containment area.

6. The rollable paint tray defined in claim 5 wherein the drainage channels converge toward paint containment area.

7. The rollable paint tray defined in claim 5 wherein the paint roller containment area has opposing ends and wherein the drainage channels are positioned at the opposing ends of the paint roller containment area.

8. The rollable paint tray defined in claim 5 wherein the rolling surface area further comprises a rolling orientation where the workpiece paint roller is routinely moved during the painting procedure and wherein the drainage channels each have a directional orientation and wherein the directional orientation of the drainage channels are offset relative to the rolling orientation of the rolling surface area.

9. The rollable paint tray defined in claim 1 wherein the paint roller containment area further comprises a base having a curved contour.

10. The rollable paint tray defined in claim 1 wherein the body is a one piece molded member.

11. The rollable paint tray defined in claim 1 wherein the body further comprises a plurality of rolling member attachment positions, and wherein each of the rolling members is detachably attachable to a respective rolling member attachment position.

12. The rollable paint tray defined in claim 1 wherein the rolling surface area further comprises a plurality of elevated strips positioned thereon.

13. The rollable paint tray defined in claim 12 wherein each of the elevated strips has a generally linear orientation.

14. The rollable paint tray defined in claim 12 wherein the rolling surface area further comprises a rolling orientation where the workpiece paint roller is routinely moved during the painting procedure and wherein each of the elevated strips has a directional orientation and wherein the directional orientation of each of the elevated strips is offset relative to the rolling orientation of the rolling surface area.

15. The rollable paint tray defined in claim 1 wherein the paint roller containment area further comprises a base having an elevational height and wherein the workpiece paint containment area further comprises a base having an elevational height and wherein the elevational height of the base of the paint roller containment area is significantly elevated above the elevational height of the base of the workpiece paint containment area.

16. The rollable paint tray defined in claim 1 wherein the paint roller containment area further comprises a base having an elevational height and wherein the roller surface further comprises a lowest elevational extent and wherein base of the paint roller containment area is higher that the lowest elevational extent of the roller surface.

17. The rollable paint tray defined in claim 1 wherein the workpiece paint containment area further comprises a width and a depth, the width extending forward from a terminal edge of the roller surface, the depth extending downward from the terminal edge of the roller surface, and wherein the width and the depth of the workpiece paint containment area are generally equal.

18. A rollable paint tray to retain workpiece paint during a painting procedure performed with a workpiece paint roller assembly, the workpiece paint roller assembly having a workpiece paint roller, a workpiece paint roller retention assembly and an elongated workpiece handle, the workpiece paint roller retention assembly to provide for axial rotation of the workpiece paint roller, the elongated workpiece handle attached to the workpiece paint roller retention assembly to provide for significant spacing of the user from the workpiece paint roller during the painting procedure, the rollable paint tray comprising:

a) a body having a usage orientation during the painting procedure relative to a generally flat support surface, the body comprising:

i) a workpiece paint containment area to provide for containing a quantity of the workpiece paint, the workpiece paint containment area readily accessible for transfer of a portion of the workpiece paint contained in the workpiece paint containment area to the workpiece paint roller assembly during the painting procedure;

ii) a rolling surface area to provide for distribution of workpiece paint onto the workpiece paint roller assembly during the painting procedure, the rolling surface area having an angular offset from horizontal when the rollable paint tray is positioned in the usage orientation and an angular offset from vertical when the rollable paint tray is positioned in the usage orientation and wherein the angular offset from horizontal is significantly less than the angular offset from vertical;

iii) a paint roller containment area to provide for the workpiece paint roller of the workpiece paint roller assembly to be placed relative to the rollable paint tray wherein the user may manipulate the elongated workpiece handle of the workpiece paint roller assembly to easily move the rollable paint tray about on the generally flat support surface during the painting procedure;

and wherein the paint roller containment area further comprises drainage means to provide for at least a portion of the workpiece paint deposited in the paint roller containment area to drain into the workpiece paint containment area of the body of the rollable paint tray;

and wherein the drainage means further comprises at least two drainage channels extending across the roller surface from the paint roller containment area to the workpiece paint containment area;

and wherein each of the drainage channels have a first depth relative to the roller surface and a second depth relative to the roller surface and wherein the first depth is greater than the second depth and wherein the first depth is positioned adjacent the paint roller containment area and wherein the second depth is positioned adjacent the workpiece paint containment area;

b) a plurality of rolling members attached relative to the body of the rollable paint tray, the rolling members to provide for ready movement of the rollable paint tray over the generally flat support surface during the painting procedure.

19. A rollable paint tray to retain workpiece paint during a painting procedure performed with a workpiece paint roller assembly, the workpiece paint roller assembly having a workpiece paint roller, a workpiece paint roller retention assembly and an elongated workpiece handle, the workpiece paint roller retention assembly to provide for axial rotation of the workpiece paint roller, the elongated workpiece handle attached to the workpiece paint roller retention assembly to provide for significant spacing of the user from the workpiece paint roller during the painting procedure, the rollable paint tray comprising:

a) a body having a usage orientation during the painting procedure relative to a generally flat support surface, the body comprising:

i) a workpiece paint containment area to provide for containing a quantity of the workpiece paint, the workpiece paint containment area readily accessible for transfer of a portion of the workpiece paint contained in the workpiece paint containment area to the workpiece paint roller assembly during the painting procedure;

ii) a rolling surface area to provide for distribution of workpiece paint onto the workpiece paint roller assembly during the painting procedure, the rolling surface area having an angular offset from horizontal when the rollable paint tray is positioned in the usage orientation and an angular offset from vertical when the rollable paint tray is positioned in the usage orientation and wherein the angular offset from horizontal is significantly less than the angular offset from vertical;

and wherein the rolling surface area further comprises a plurality of elevated strips positioned thereon;

and wherein the rolling surface area further comprises a rolling orientation where the workpiece paint roller is routinely moved during the painting procedure and wherein each of the elevated strips has a directional orientation and wherein the directional orientation of each of the elevated strips is offset relative to the rolling orientation of the rolling surface area;

iii) a paint roller containment area to provide for the workpiece paint roller of the workpiece paint roller assembly to be placed relative to the rollable paint tray wherein the user may manipulate the elongated workpiece handle of the workpiece paint roller assembly to easily move the rollable paint tray about on the generally flat support surface during the painting procedure;

b) a plurality of rolling members attached relative to the body of the rollable paint tray, the rolling members to provide for ready movement of the rollable paint tray over the generally flat support surface during the painting procedure;

c) further comprises at least two drainage channels extending across the roller surface to provide for at least a portion of the workpiece paint deposited in the paint roller containment area to drain into the workpiece paint containment area of the body of the rollable paint tray and wherein the drainage channels each have a directional orientation and wherein the directional orientation of the drainage channels are offset relative to the rolling orientation of the rolling surface area and wherein each of the elevated strips of the rolling surface area is aligned with one of the drainage channels.

* * * * *